US008177494B2

(12) United States Patent
Ward et al.

(10) Patent No.: US 8,177,494 B2
(45) Date of Patent: May 15, 2012

(54) BURIED CASING TREATMENT STRIP FOR A GAS TURBINE ENGINE

(75) Inventors: Thomas W. Ward, Manchester, CT (US); John P. Virtue, Middletown, CT (US)

(73) Assignee: United Technologies Corporation, Hartford, CT (US)

( * ) Notice: Subject to any disclaimer, the term of this patent is extended or adjusted under 35 U.S.C. 154(b) by 556 days.

(21) Appl. No.: 12/404,325

(22) Filed: Mar. 15, 2009

(65) Prior Publication Data

US 2010/0232943 A1 Sep. 16, 2010

(51) Int. Cl.
*F01D 11/12* (2006.01)

(52) U.S. Cl. ..... 415/173.4; 416/116; 416/200; 416/173.1; 416/173.2

(58) Field of Classification Search ..... 415/116, 415/200, 173.1–173.4
See application file for complete search history.

(56) References Cited

U.S. PATENT DOCUMENTS 3,936,656 A 2/1976 Middleton et al.
4,063,847 A 12/1977 Simmons
4,578,942 A 4/1986 Weiler
4,606,699 A 8/1986 Hemsworth
4,645,417 A 2/1987 Wisler
5,113,582 A 5/1992 Monson et al.
5,113,646 A 5/1992 Cox
5,154,578 A 10/1992 Miraucourt et al.
5,201,801 A 4/1993 Smith, Jr.
5,885,056 A 3/1999 Goodwin
6,220,602 B1 4/2001 Webster et al.
6,234,747 B1 5/2001 Mielke et al.
6,532,656 B1 3/2003 Wilkins et al.
6,547,522 B2 4/2003 Turnquist et al.
6,585,479 B2 * 7/2003 Torrance ..... 415/58.5
6,830,428 B2 12/2004 Le Biez et al.
6,832,890 B2 12/2004 Booth
6,840,519 B2 1/2005 Dinc et al.
6,905,305 B2 6/2005 James
6,935,836 B2 8/2005 Ress, Jr. et al.
7,155,800 B2 1/2007 Adis et al.
7,255,929 B2 8/2007 Turnquist et al.
7,287,957 B2 10/2007 Jahns et al.
7,402,022 B2 7/2008 Harper et al.
7,407,369 B2 8/2008 Schwarz et al.
7,448,849 B1 11/2008 Webster et al.
2006/0056961 A1 * 3/2006 Czachor et al. ..... 415/173.4
2007/0147989 A1 * 6/2007 Collins ..... 415/173.1

* cited by examiner

*Primary Examiner* — Dung A. Le
(74) *Attorney, Agent, or Firm* — Carlson Gaskey & Olds P.C.

(57) ABSTRACT

A multiple of circumferential grooves within said arcuate engine casing and an abradable material located radial inboard of the multiple of circumferential grooves.

21 Claims, 2 Drawing Sheets

| | |
|---|---|
| PERFORMANCE | GOOD |
| STALL MARGIN | GOOD |

| | |
|---|---|
| PERFORMANCE | POOR |
| STALL MARGIN | GOOD |

BURIED CASING TREATMENT STRIP FOR A GAS TURBINE ENGINE

BACKGROUND

The present disclosure relates to gas turbine engines, and more particularly to circumferential grooves under a layer of abradable material to retain compressor stability performance associated with tight clearances late into the engine overhaul cycle.

In a gas turbine engine, air is compressed in various fan and compressor stages by rotor blades which cooperate with stator vanes. Fan air provides primary bypass propulsion thrust while compressor air is mixed with fuel and ignited for generation of hot combustion gases from which energy is extracted by turbine stages which power the compressor section and fan section.

Compressor blade tip clearances are a significant component of desirable performance as defined by fuel efficiency, and compressor stability as defined by stall margin. During certain transient conditions of the engine, differential expansion or contraction, or other radial movement between the engine casing and the blades may cause intermittent blade tip rubbing against the engine casing. Blade tip rubbing generates abrasion and friction heat that may subject the blade tips and engine casing to locally high stress. Blade tip rubbing may be reduced or eliminated by an increase of the nominal blade tip clearance, but this may result in a corresponding decrease in desirable performance and compressor stability. Maintenance of desirable performance and compressor stability is thus a tradeoff between blade tip clearance and the potential for blade tip rubbing.

One system that facilitates efficient engine operation is a rub strip. Rub strips include abradable coatings within the engine case. The abradable coating is at least partially eroded during engine break-in to provide efficient performance and compressor stability throughout a majority of the engine overhaul cycle. The abradable coating within the rub strip is relatively soft enough to protect the blade tips during regular operation but generally too soft to survive over a prolonged time period or from an isolated unanticipated rub event. Erosion of the rub strip increase the blade tip clearances that adversely affect both performance and compressor stability over time.

Another system that facilitates engine operation is a plurality of circumferential grooves disposed in the inner surface of the engine casing. When the rotor blades operate efficiently, airflow is pumped from the lower-pressure region forward of the rotor blades to the higher pressure region behind the rotor blades. Stall may occur when air leaks from the aft higher-pressure region, over the tip, to the forward lower-pressure region. The circumferential grooves assures effective compressor stability over the engine overhaul life cycle at the tradeoff of relatively less desirable performance as defined by fuel efficiency.

SUMMARY

A buried casing treatment strip according to an exemplary aspect of the present disclosure includes a multiple of circumferential grooves and an abradable material located radial inboard of said multiple of circumferential grooves.

An engine section according to an exemplary aspect of the present disclosure includes a buried casing treatment strip formed within an arcuate engine casing adjacent a multiple of blade tips, the buried casing treatment strip having an abradable material located radial inboard of a multiple of circumferential grooves.

A method of mitigating excessive blade tip clearance in a gas turbine engine according to an exemplary aspect of the present disclosure includes revealing a multiple of circumferential grooves through erosion of an abradable material by a multitude of circumferentially spaced apart blades within a gas turbine engine.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
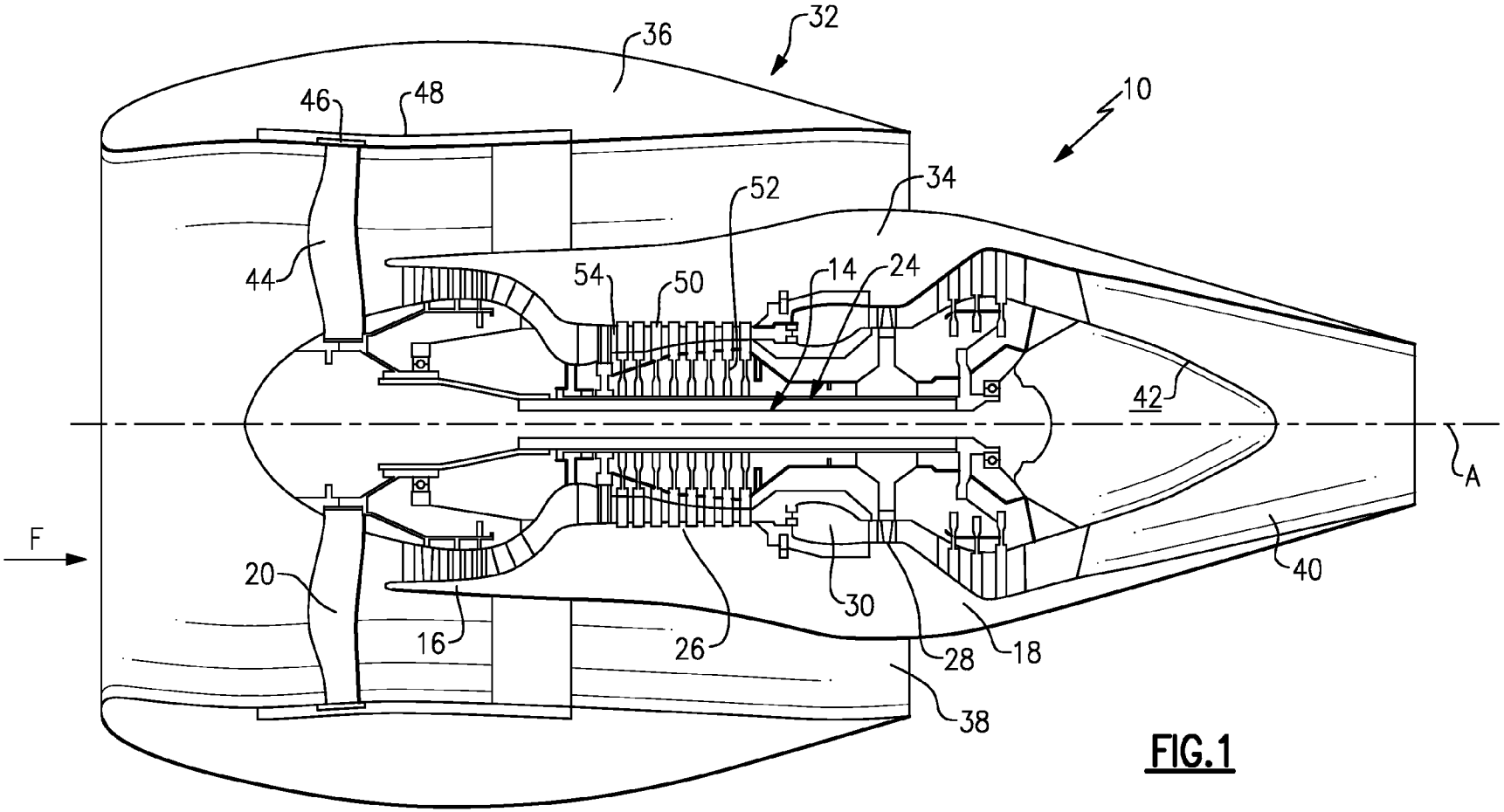
FIG. 1 is a general schematic view of an exemplary gas turbine engine for use with the present disclosure.

FIG. 1 illustrates a general schematic view of a gas turbine engine 10 such as a gas turbine engine for propulsion. The exemplary engine 10 in the disclosed non-limiting embodiment is in the form of a two spool high bypass turbofan engine. While a particular type of gas turbine engine is illustrated, it should be understood that the disclosure is applicable to other gas turbine engine configurations, including, for example, gas turbines for power generation, turbojet engines, low bypass turbofan engines, turboshaft engines, etc.

The engine 10 includes a core engine section that houses a low spool 14 and high spool 24. The low spool 14 includes a low pressure compressor 16 and a low pressure turbine 18. The core engine section drives a fan section 20 connected to the low spool 14 either directly or through a gear train. The high spool 24 includes a high pressure compressor 26 and high pressure turbine 28. A combustor 30 is arranged between the high pressure compressor 26 and high pressure turbine 28. The low and high spools 14, 24 rotate about an engine axis of rotation A.

The exemplary engine 10 is mounted within a nacelle assembly 32 defined by a core nacelle 34 and a fan nacelle 36. The bypass flow fan air F is discharged through a fan nozzle section 38 generally defined between the core nacelle 34 and a fan nacelle 36. Air compressed in the compressor 16, 26 is mixed with fuel, burned in the combustor 30, and expanded in the turbines 18, 28. The air compressed in the compressors 16, 18 and the fuel mixture expanded in the turbines 18, 28 may be referred to as a hot gas stream along a core gas path. The core exhaust gases C are discharged from the core engine through a core exhaust nozzle 40 generally defined between the core nacelle 34 and a center plug 42 disposed coaxially therein around an engine longitudinal centerline axis A.

The fan section 20 includes a plurality of circumferentially spaced fan blades 44 which may be made of a high-strength, low weight material such as a titanium alloy. An annular blade containment structure 46 is typically disposed within a fan case 48 which circumferentially surrounds the path of the fan blades 44 to receive blade fragments which may be accidentally released and retained so as to prevent formation of free projectiles exterior to fan jet engine 10.

The compressor 16, 26 includes alternate rows of rotary airfoils or blades 50 mounted to disks 52 and static airfoils or vanes 54 which at least partially define a compressor stage. It should be understood that a multiple of disks 52 may be contained within each engine section and that although a single compressor stage is illustrated and described in the disclosed embodiment, other stages which have other blades inclusive of fan blades, high pressure compressor blades and low pressure compressor blades may also benefit herefrom.

Figure 2A:
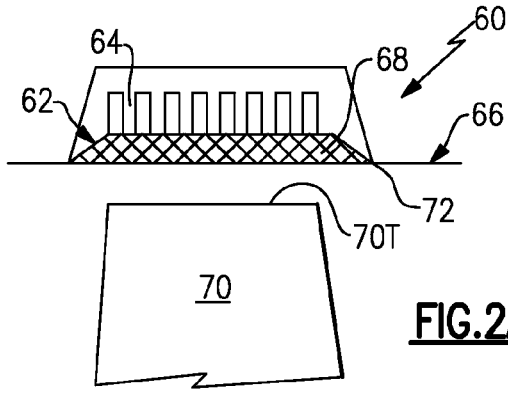
FIG. 2A is a schematic sectional view of a rotor blade adjacent a buried casing treatment strip in a build condition.

Referring to FIG. 2A, a buried casing treatment strip 60 includes a rub strip 62 and a multiple of circumferential grooves 64 located within a static structure 66 such as in a fixed material of the buried casing treatment strip 60 or within the engine case structure itself circumferentially outboard of a multiple of blades 70. That is, the buried casing treatment strip 60 may be single component strip which includes both the rub strip 62 and the multiple of circumferential grooves 64.

Blade tips 70T are closely fitted to the buried casing treatment strip 60 to provide a sealing area that reduces air leakage past the blade tips 70T. The multiple of blades 70, although illustrated schematically, are representative of compressor blades, fan blades, or other blades which may utilize a rub strip type system. The rub strip 62 includes an abradable material 68 which may be abraded when in intermittent contact with the blade tips 70T during operation.

Figure 2B:
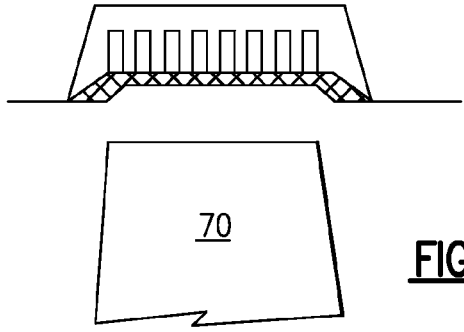
FIG. 2B is a schematic sectional view of a rotor blade adjacent a buried casing treatment strip after a break-in period.
Figure 2C:
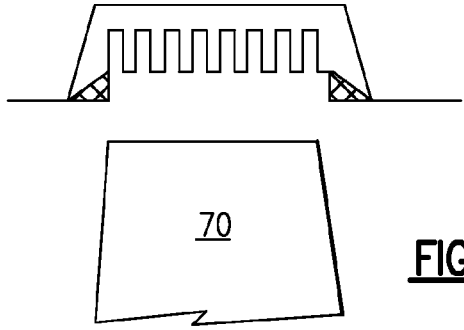
FIG. 2C is a schematic sectional view of a rotor blade adjacent a buried casing treatment strip after an isolated unanticipated rub event or after a prolonged period of time or break-in period.

The rub strip 62 is located at a radial inboard location of the multiple of circumferential grooves 64 formed within the static structure 66. The abradable material 68 within the rub strip 62 may be initially generally flush with an inner surface 72 of the engine case which is at least partially abraded during engine break-in to provide optimum performance and compressor stability during the primary portion of the engine overhaul cycle (FIG. 2B). Over a prolonged period of time or due in part to an isolated unanticipated rub events, the abradable material 68 is essentially eroded away to expose the circumferential grooves 64 (FIG. 2C).

As the abradable material 68 erodes, the stability margin will drop as the blade tip 70T clearances open. The blade tip 70T clearances and thus the stability margin continue to increase to a predetermined threshold where the abradable material 68 has been completely eroded (FIG. 2C). Beyond this predetermined threshold, the multiple of circumferential grooves 64 formed within the static structure 66 are revealed and the stability margin is essentially restored. It should be understood that the predetermined threshold may be defined in relation to the expected engine overhaul cycle or other such relationship to set the depth of the abradable material 68. The buried casing treatment strip 60 provides the desired performance associated with tight clearances early in the engine overhaul cycle (FIG. 2B) and assures stability margin late in the engine overhaul cycle (FIG. 2C).

Only once the clearance has opened beyond the predefined threshold will the multiple of circumferential grooves 64 be revealed. The improvements in stability margin increase engine overhaul times and field management plans associated with regard to compressor stability. The buried casing treatment strip 60 also assures compressor stability margins after an isolated unanticipated rub event such as an icing event which may rapidly erode the abradable material 68.

During overhaul it is also possible to replace existing rubstrip material with a rub strip 62 as disclosed herein with minimal modification to the existing casing structure. That is, the rub strip 62 essentially will drop in and replace the conventional rubstrip.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A buried casing treatment strip comprising:
a multiple of circumferential grooves; and
an abradable material located radial inboard of said multiple of circumferential grooves.

2. The buried casing treatment strip as recited in claim 1, wherein said abradable material and said multiple of circumferential grooves define a rub strip positionable radially outboard of a multitude of circumferentially spaced apart blades which extend radially outwardly from a disk of a gas turbine engine.

3. The buried casing treatment strip as recited in claim 2, wherein said multitude of circumferentially spaced apart blades are compressor blades.

4. The buried casing treatment strip as recited in claim 2, wherein said multitude of circumferentially spaced apart blades are fan blades.

5. The buried casing treatment strip as recited in claim 1, wherein said abradable material is generally flush with an inner surface of an engine casing when installed therein.

6. An engine section comprising:
a rotor disk;
a multitude of circumferentially spaced apart blades which extend in a radial direction from said disk to a blade tip;
an arcuate engine casing which surrounds said blade tips; and
a buried casing treatment strip formed within said arcuate engine casing adjacent said blade tips, said buried casing treatment strip having an abradable material located radial inboard of a multiple of circumferential grooves.

7. The engine section as recited in claim 6, wherein said multitude of circumferentially spaced apart blades are compressor blades.

8. The engine section as recited in claim 6, wherein said multitude of circumferentially spaced apart blades are fan blades.

9. A method of mitigating excessive blade tip clearance in a gas turbine engine comprising:
revealing a multiple of circumferential grooves through erosion of an abradable material by a multitude of circumferentially spaced apart blades within a gas turbine engine.

10. The method as recited in claim 9, further comprising:
locating the abradable material outboard of the multitude of circumferentially spaced apart blades.

11. The method as recited in claim 9, further comprising:
locating the multiple of circumferential grooves outboard of the abradable material.

12. The method as recited in claim 9, wherein revealing the multiple of circumferential grooves occurs at a predetermined threshold relative to a stability margin of the gas turbine engine.

13. The buried casing treatment strip as recited in claim 1, wherein said abradable material covers said multiple of circumferential grooves.

14. The buried casing treatment strip as recited in claim 1, wherein said multiple of circumferential grooves are closed grooves opposite said abradable material.

15. The buried casing treatment strip as recited in claim 1, wherein said abradable material closes said multiple of circumferential grooves.

16. The engine section as recited in claim 6, wherein said abradable material covers said multiple of circumferential grooves.

17. The engine section as recited in claim 6, wherein said multiple of circumferential grooves are closed grooves opposite said abradable material.

18. The method as recited in claim 12, wherein revealing the multiple of circumferential grooves restores a stability margin.

19. The method as recited in claim 9, wherein revealing the multiple of circumferential grooves restores a stability margin.

20. The method as recited in claim 9, further comprising covering the multiple of circumferential grooves with the abradable material.

21. The method as recited in claim 9, wherein revealing the multiple of circumferential grooves occurs via rubbing with a multitude of circumferentially spaced apart blades which extend in a radial direction to the blade tip.

* * * * *